US007543702B2

(12) United States Patent
Conti et al.

(10) Patent No.: US 7,543,702 B2
(45) Date of Patent: Jun. 9, 2009

(54) PACK OF RIGID TYPE FOR TOBACCO PRODUCTS

(75) Inventors: Igino Conti, Bologna (IT); Fiorenzo Draghetti, Medicina (IT); Patrizia Persi, Monte S. Pietro (IT)

(73) Assignee: G.D S.p.A., Bologna (IT)

( * ) Notice: Subject to any disclaimer, the term of this patent is extended or adjusted under 35 U.S.C. 154(b) by 1129 days.

(21) Appl. No.: 10/381,663

(22) PCT Filed: Oct. 1, 2001

(86) PCT No.: PCT/IB01/01821

§ 371 (c)(1),
(2), (4) Date: Mar. 28, 2003

(87) PCT Pub. No.: WO02/28745

PCT Pub. Date: Apr. 11, 2002

(65) Prior Publication Data

US 2004/0026271 A1 Feb. 12, 2004

(30) Foreign Application Priority Data

Oct. 3, 2000 (IT) ..... BO2000A0576

(51) Int. Cl.
*B65D 85/10* (2006.01)
*B65D 43/16* (2006.01)

(52) U.S. Cl. ..... 206/268; 206/259; 206/273; 206/831; 229/160.1

(58) Field of Classification Search ..... 206/242, 206/259, 261, 264–265, 268, 271, 273, 831; 229/160.1
See application file for complete search history.

(56) References Cited

U.S. PATENT DOCUMENTS

| | | | | |
|---|---|---|---|---|
| 4,948,038 | A * | 8/1990 | Moeller | 229/146 |
| 5,236,084 | A | 8/1993 | Evers | |
| 5,375,704 | A | 12/1994 | Focke et al. | |
| 5,715,936 | A | 2/1998 | Focke et al. | |

(Continued)

FOREIGN PATENT DOCUMENTS

| | | |
|---|---|---|
| DE | 19841942 | 3/2000 |

(Continued)

*Primary Examiner*—Bryon P Gehman
(74) *Attorney, Agent, or Firm*—Timothy J. Klima

(57) ABSTRACT

A pack of rigid type with a hinged lid for tobacco products comprises a cupped container (3; 26) presenting a front face (8) and two flank faces (10) of which the free edges (8*a*, 10*a*) combine to establish an open end (4) of the container, also a reinforcing frame (15) secured to the container (3; 26), presenting a breast piece (16), two side pieces (17) and a top edge (18) of U profile directed toward the lid (5; 27). The lid (5; 27) likewise is cupped, presenting a front face (11) and two flank faces (13) with respective free edges (11*a*, 13*a*), and closes the open end (4) of the container (3; 26). A coupon (19) is included in the pack, between the frame (15) and the tobacco products. With the lid (5; 27) occupying the closed position, the free edges (8*a*, 11*a*) presented by the front faces (8, 11) respectively of the container (3; 26) and of the lid (5; 27) are separated one from the other by a given distance to create an opening (20) partially exposing the breast piece (16) of the frame (15), which in turn presents at least one window (23) serving to reveal at least one portion (24) of the coupon (19).

20 Claims, 7 Drawing Sheets

U.S. PATENT DOCUMENTS

| | | | | | |
|---|---|---|---|---|---|
| 5,845,770 | A * | 12/1998 | James et al. | ..... | 206/268 |
| 6,138,823 | A * | 10/2000 | Focke et al. | ..... | 206/259 |
| 6,360,943 | B1 | 3/2002 | Focke et al. | | |
| 6,474,469 | B1 * | 11/2002 | Luton et al. | ..... | 206/268 |
| 6,513,651 | B1 | 2/2003 | Focke et al. | | |
| 6,736,262 | B2 * | 5/2004 | Focke et al. | ..... | 206/268 |
| 6,742,652 | B1 * | 6/2004 | Focke et al. | ..... | 206/268 |

FOREIGN PATENT DOCUMENTS

| | | |
|---|---|---|
| DE | 19858786 | 6/2000 |
| DE | 19906473 | 8/2000 |
| EP | 087081 | 8/1983 |
| WO | 00/05151 | 3/2000 |
| WO | 01/12528 | 2/2001 |

* cited by examiner

PACK OF RIGID TYPE FOR TOBACCO PRODUCTS

This application is the National Phase of International Application PCT/IB01/01821 filed Oct. 1, 2001 which designated the U.S. and that International Application was published under PCT Article 21(2) in English.

TECHNICAL FIELD

The present invention relates to a pack of rigid type for tobacco products.

BACKGROUND ART

In the following specification, the term "pack" can be taken to mean both a carton containing a plurality of packets of cigarettes, and a single packet containing a group of cigarettes or tobacco products in general.

Rigid packs of the type in question are fashioned generally from respective flat precreased diecut blanks, the single pack comprising a container and a lid which, in the case of the packet in particular, is attached hingedly to a rear edge of the container in such a way as to enclose an open end of the selfsame container, also a reinforcing frame disposed partly inside the container and secured thus internally to a front face and to two flank faces of the selfsame container.

It is increasingly the practice to print advertisements, messages and other written matter on the outer surface of these packs, addressed to the consumer, which must be placed clearly in view, expressed in the language of the various countries where the product is sold and, moreover, customized on a case by case basis to ensure conformity with national statutory requirements in different countries.

In certain countries it is also normal for the price of the product to be printed on the outer surface of the pack and, especially in those countries where changes in price are frequent due to significant inflationary factors, the written matter printed on the pack must often be changed and adapted in response to market conditions.

All this dictates that the diecut blanks used to fashion the packs must be differentiated from country to country, and even for each individual country, with resulting high inventory and production costs.

It is also the practice to manufacture packs of the type in question furnished internally with inserts, namely cards, coupons and the like, bearing written and pictorial images addressed to the consumer.

The object of the present invention is to avoid the use of different blanks, since the blank represents the most costly part of the pack, adopting a single standard blank for all countries and utilizing the inserts as the background on which to print the advertisements, messages and other written matter addressed to the consumer.

DISCLOSURE OF THE INVENTION

The stated object is realized according to the present invention in a pack of rigid type with a hinged lid for tobacco products, comprising a container of cupped embodiment presenting a bottom end face and a rear race, also a front face and two flank faces of which the free edges define an open end of the selfsame container; a reinforcing frame presenting a breast piece and two side pieces associated respectively with the front face and flank faces of the container, projecting partly from the open end of the container and delimited uppermost by an edge of U profile directed toward the lid; the lid likewise of cupped embodiment and presenting a top end face, a front face and two flank faces with respective free edges, and a rear face connected by way of a hinge line to the rear face of the container, rotatable thus between an open position and a position of interaction with the frame in which the open end of the container is closed; and a coupon located between the frame and the tobacco products, characterized in that, with the lid occupying the closed position, at least one part of the free edge afforded by the open end of the container and a part of the free edge of the lid are separated one from the other by a predetermined distance so as to create an opening that serves to expose at least one void portion of the frame serving in turn to reveal at least one corresponding portion of the coupon.

The invention will now be described in detail, by way of example, with the aid of the accompanying drawings, in which.

Figure 1:
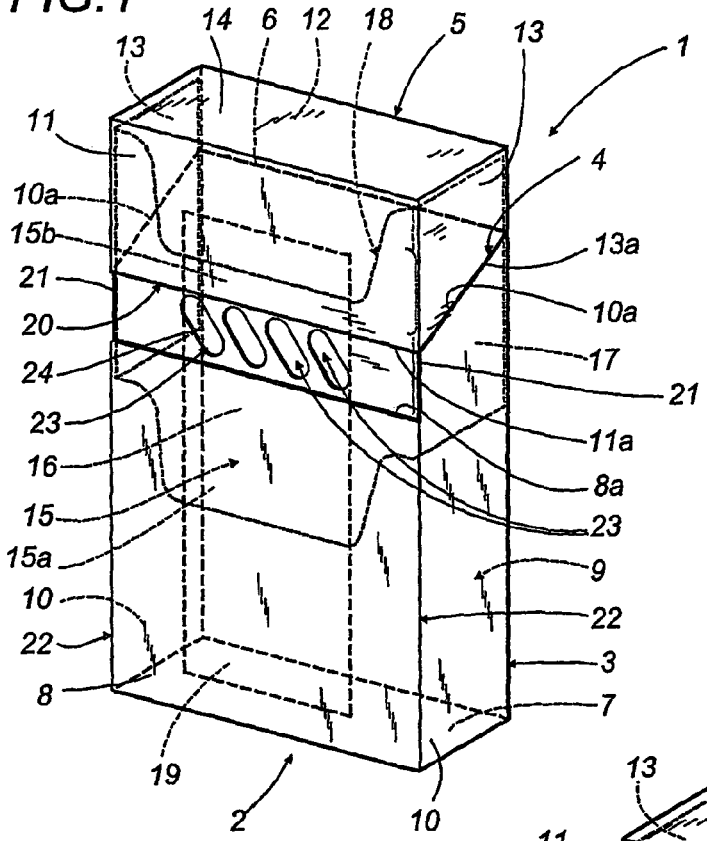
FIG. 1 illustrates a first embodiment of a packet of cigarettes according to the present invention, viewed schematically and in perspective.
Figure 2:
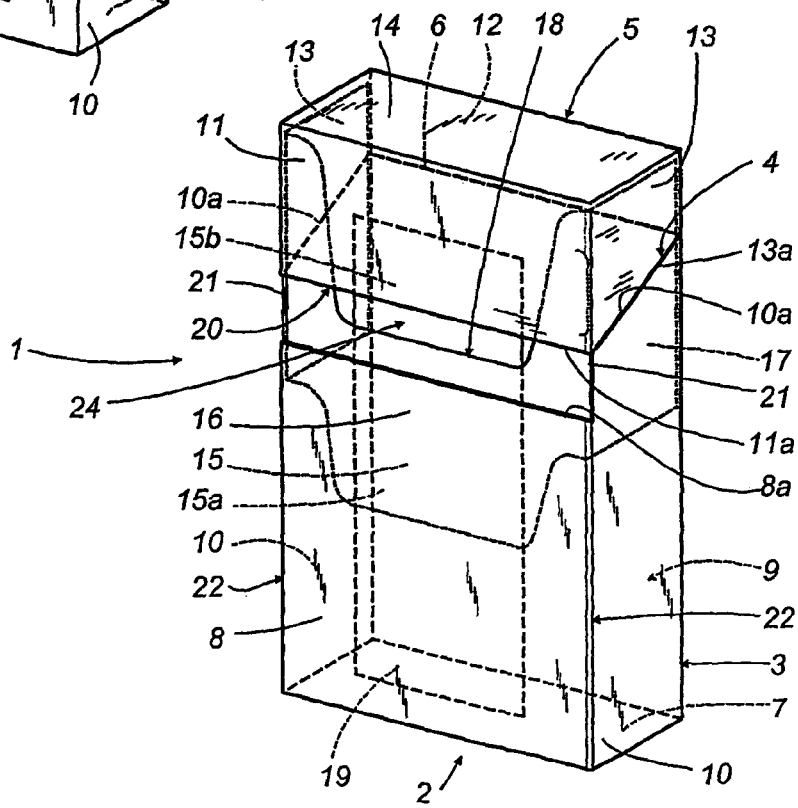
FIG. 2 illustrates a second embodiment of a packet of cigarettes according to the present invention, viewed schematically and in perspective.

With reference to FIGS. 1 and 2 of the drawings, 1 denotes a pack for tobacco products, in its entirety, consisting more exactly in a rigid packet 2 intended to contain a group of cigarettes (not illustrated), comprising a container 3 of cupped embodiment affording an open top end 4, surmounted by a lid 5 likewise of cupped embodiment, hinged to the container 3 along a relative hinge line 6 and rotatable thus between an open position (not illustrated), and a position in which the top end 4 is closed.

The container 3 presents a bottom end face 7, a front face 8, a rear face 9 and two flank faces 10, of which the front face 8 and flank faces 10 present respective free top edges 8*a* and 10*a* defining the open top end 4, that is to say the end directed toward the lid 5, which in like manner presents a front face 11, a rear face 12, two flank faces 13 and a top end face 14.

The front face 11 and flank faces 13 of the lid 5 present respective free edges 11*a* and 13*a* defining an open end offered to the container 3 when the selfsame lid 5 is in the closed position.

The single packet 2 accommodates an inner wrapper (not illustrated) enveloping a group of cigarettes, and is furnished with a reinforcing frame 15, interposed between the packet 2 and the inner wrapper and secured thus to the container 3. The frame 15 comprises a portion 15*a* located internally of the container 3 and a portion 15*b* projecting externally of the container from the open top end 4.

More exactly, the frame 15 is composed of a breast piece 16 located partly in contact with the inside of the front face 8 of the container 3, and two side pieces 17 secured in part to the insides of the flank faces 10 of the container 3.

The breast piece 16 of the frame 15 is delimited uppermost by an edge 18 of "U" outline disposed with the concave profile directed toward the lid 5.

Lastly, each packet 2 is furnished with a coupon 19 interposed between the frame 15 and the inner wrapper. More exactly, the coupon 19 is positioned below the breast piece 16 of the frame 15 and partly in contact with the inside of the front face 8 of the container 3, in such a way that its top end extends beyond the top edge 18 of the frame 15.

In the example of FIG. 1, where the hinged lid 5 occupies the position in which the open top end 4 of the container 3 is enclosed, the two flank edges 13*a* of the lid 5 are disposed in contact with the flank edges 10*a* of the container 3, whilst the edge 11*a* presented by the front face 11 of the lid 5 is separated by a given distance from the edge 8*a* presented by the front face 8 of the container 3, in such a way as to create an opening 20 compassed peripherally by the edge 11*a* of the front face 11 of the lid 5, the edge 8*a* of the front face 8 of the container 3, and two cuts 21 made along the top part of each corner edge 22 bordering the front face 8.

The opening 20 serves to expose a given area of the breast piece 16 presented by the frame 15, which exhibits a plurality of windows 23 consisting in respective void portions of the frame 15 positioned to reveal corresponding portions 24 of the coupon 19 bearing written and pictorial matter addressed to the consumer, thereby obviating the need to print such matter directly on the packet 2.

In the example of FIG. 2, the opening 20 is positioned to coincide with the top edge 18 of "U" outline presented by the frame 15, which therefore is not pierced with windows 23 as in the example of FIG. 1; instead, the void portion of the frame 15 is compassed between the top edge 18 of the frame 15 and the free edge 11*a* presented by the front face 11 of the lid 5 when the lid occupies the position enclosing the open top end 4 of the container 3.

Likewise in this instance the void portion of the frame 15 is positioned to expose corresponding portions 24 of the coupon 19 bearing written and pictorial matter addressed to the consumer, thereby obviating the need to print such matter directly on the packet 2.

In both of the examples illustrated in FIGS. 1 and 2, the opening 20 presents the appearance substantially of a rectangle referable to an axis extending parallel with the hinge line 6.

Figure 3:
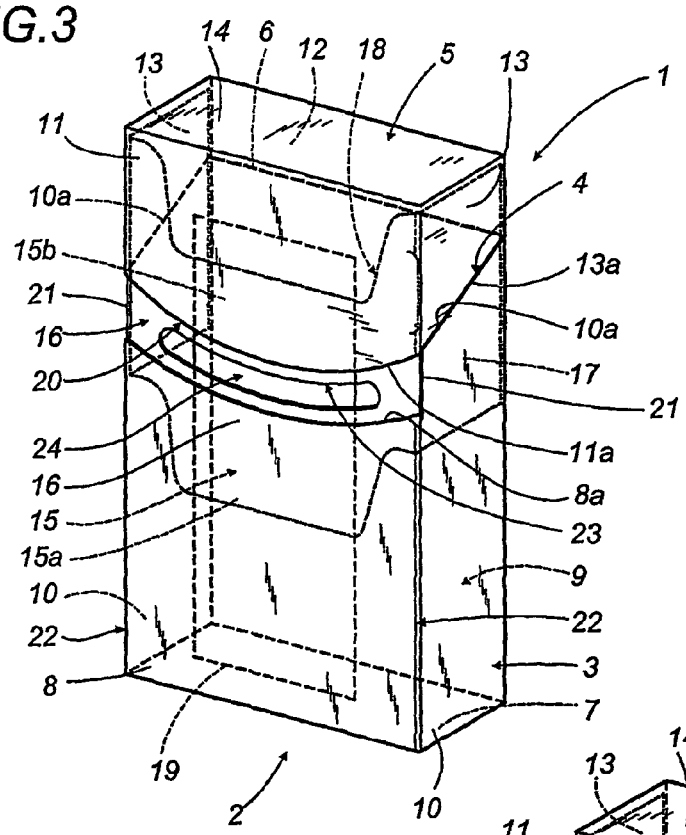
FIGS. 3 to 8 illustrate respective further embodiments of the packets of cigarettes illustrated in FIGS. 1 and 2, viewed schematically and in perspective.

The examples of FIGS. 3 to 8 are variations on the example of FIG. 1. FIG. 3, in particular, illustrates a curved opening 20 generated as a band in the form of an arc to a circle compassed between edges 8*a* and 11*a* extending mutually parallel and generated each likewise as an arc to a circle; the window 23 consists in a single void appearing as an arcuate slot.

Figure 4:
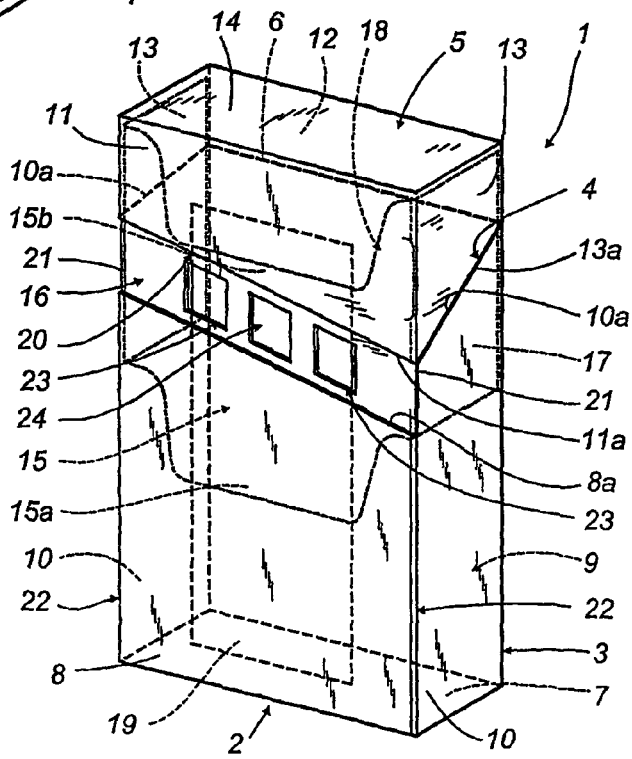

The example of FIG. 4 illustrates an opening 20 of substantially rectangular appearance referable to an axis extending skew relative to the hinge line 6, compassed between edges 8*a* and 11*a* extending mutually parallel and skew likewise in relation to the hinge line 6, whilst the frame 15 presents a plurality of windows 23, for example of substantially quadrangular outline.

Figure 5:
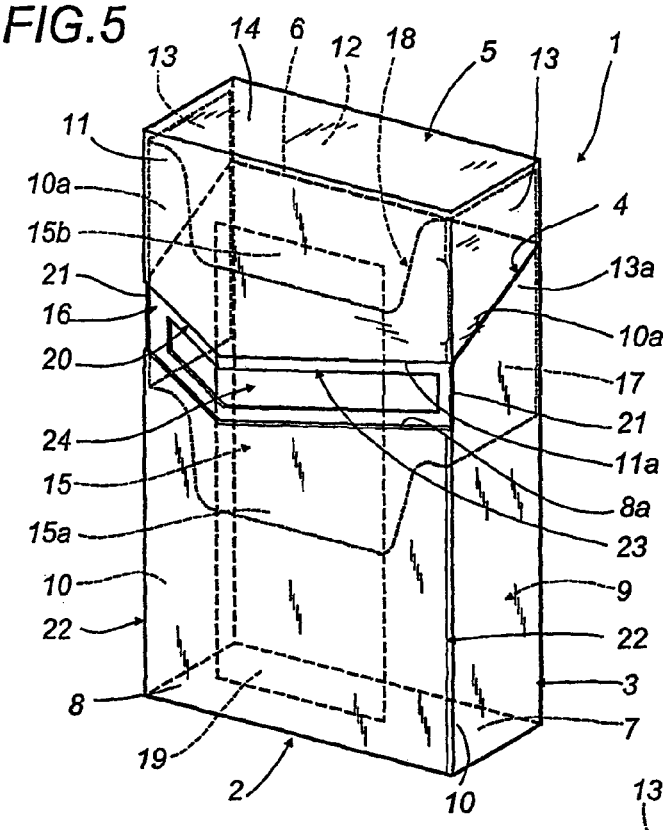

The example of FIG. 5 illustrates an opening 20 of Vee-shaped appearance compassed between edges 8*a* and 11*a* extending mutually parallel and likewise of Vee shape; the window 23 might also present a Vee shape, by way of example.

Figure 6:
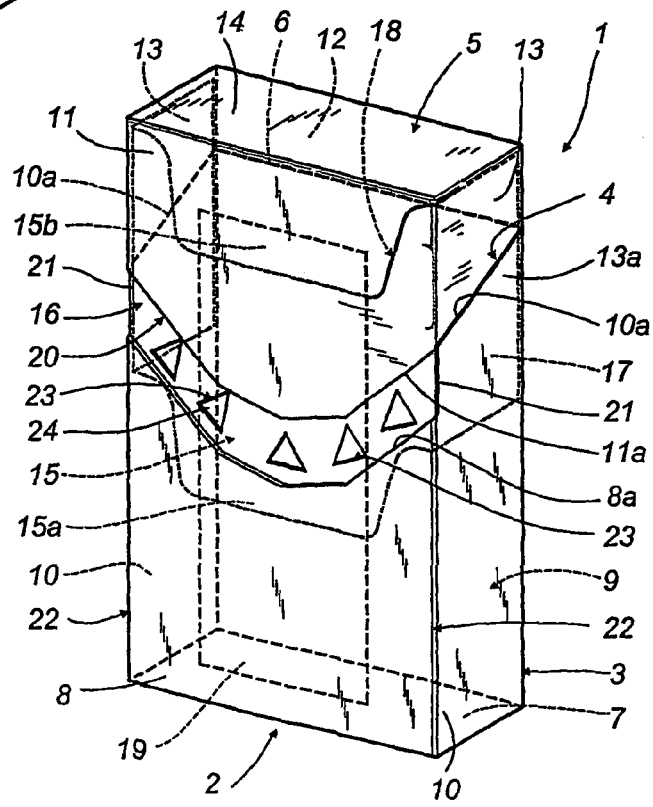

The example of FIG. 6 illustrates an opening 20 of substantially multiangular geometry compassed between edges 8*a* and 11*a* extending mutually parallel and likewise of multiangular geometry; the windows 23 might be of triangular outline, by way of example.

Figure 7:
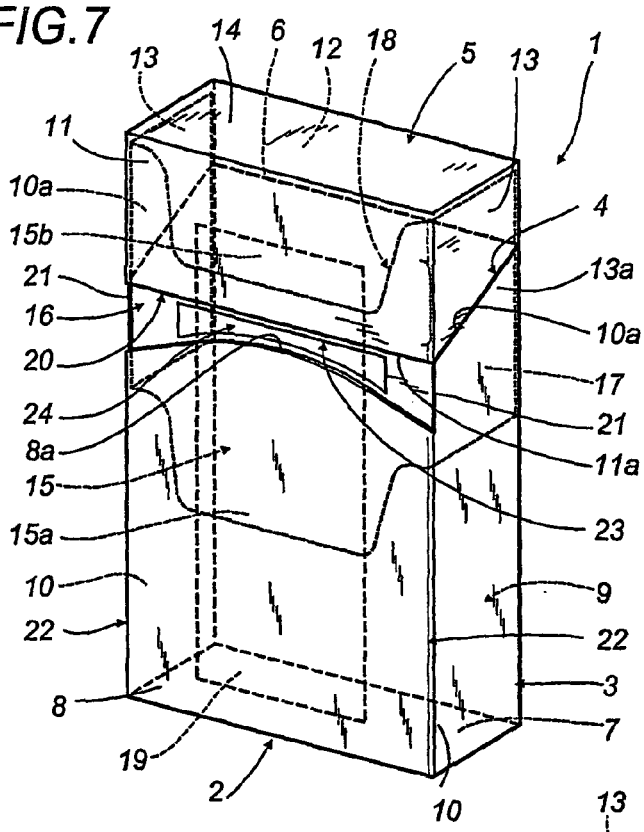

The example of FIG. 7 illustrates an opening 20 of substantially multiangular geometry compassed between edges 8*a* and 11*a* that do not extend parallel one with another. In particular, the one edge 11*a* extends parallel to the hinge line 6 and the other edge 8*a* appears substantially as a chevron with a rounded vertex directed toward the first edge 11*a*. The opening 20 exposes a single window 23 in the breast piece 16 of the frame 15, of which the outline is, by way of example, substantially identical to that of the opening 20.

Figure 8:
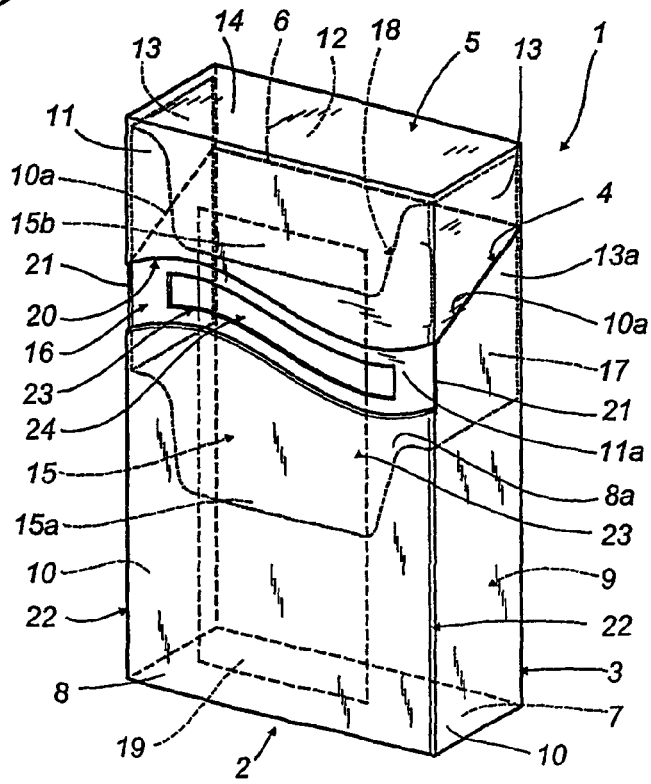

The example of FIG. 8 illustrates an opening 20 of substantially undulating appearance compassed between edges 8*a* and 11*a* extending mutually parallel and likewise of undulating appearance. In this instance the window 23 in the breast piece 16 of the frame 15 presents an undulating outline substantially identical to that of the opening 20.

Figure 9:
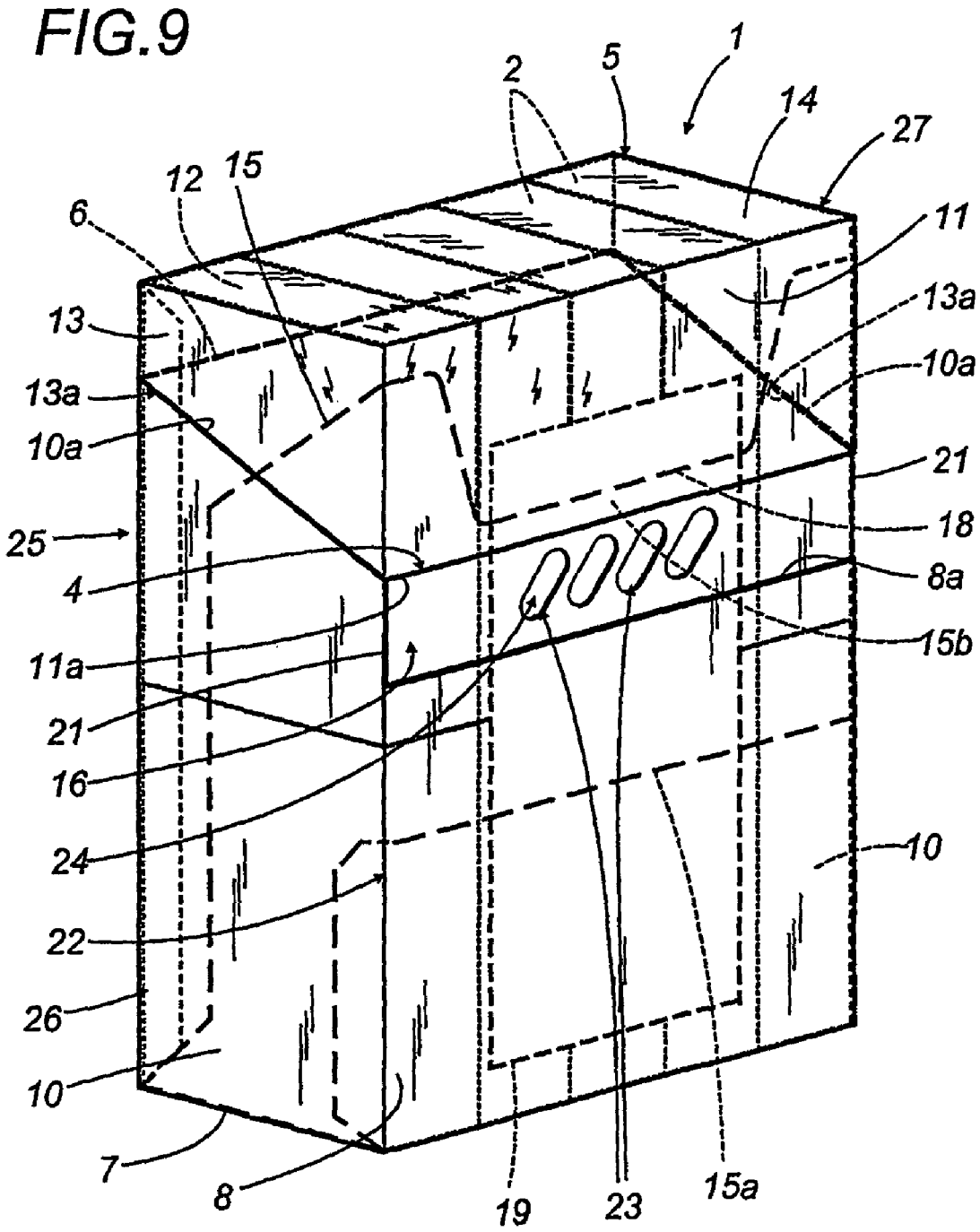
FIGS. 9 and 10 illustrate two possible embodiments of rigid cartons for packets of cigarettes according to the present invention, viewed schematically and in perspective.
Figure 10:
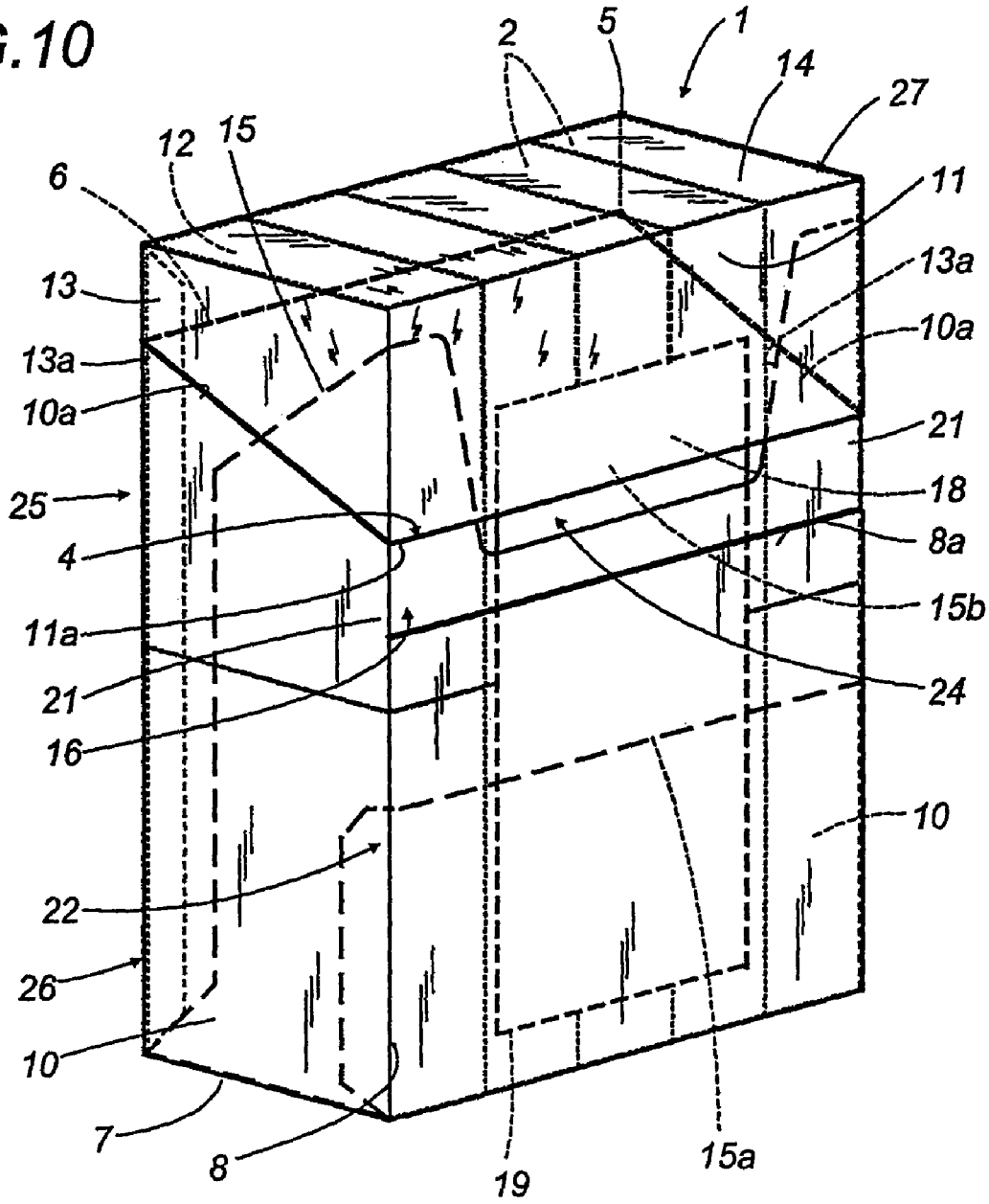

In the examples of FIGS. 9 and 10, the packs 1 consist in rigid cartons 25 serving to contain a plurality of packets 2 of cigarettes. The geometry of the cartons 25 is similar in all respects to that of the packets 2 illustrated in FIGS. 1 and 2, and accordingly, the component parts are denoted where possible by the same reference numbers as used to denote the corresponding parts of the packets 2.

The single carton 25 comprises a container 26 surmounted by a lid 27, hinged to the container along a relative hinge line 6 and rotatable thus between an open position (not illustrated) and a position in which the open top end 4 of the container 26 is closed, also a reinforcing frame 15 secured to the container 26, comprising a portion 15*a* located internally of the container 26 and a portion 15*b* projecting externally of the container 26, from the open top end 4, toward the lid 27.

The breast piece 16 of the frame 15 is delimited uppermost by an edge 18 of "U" outline disposed with the concave profile directed toward the lid 27.

Lastly, the single carton 25 is furnished with a coupon 19 interposed between the frame 15 and the packets 2. More exactly, the coupon 19 is positioned below the breast piece 16 of the frame 15 and partly in contact with the inside of the front face 8 of the container 26, in such a way that its top end extends beyond the top edge 18 of the frame 15.

Recalling the description already given with reference to the packets 2, the carton 25 illustrated in FIG. 9 appears with the lid 27 occupying the position in which the container 26 is closed. The flank edges 13*a* of the lid 27 are disposed in contact with the flank edges 10*a* of the container 26, whilst the edge 11*a* presented by the front face 11 of the lid 27 is separated by a predetermined distance from the edge 8*a* presented by the front face 8 of the container 26 in such a way as to create an opening 20 compassed peripherally by the edge 11*a* of the lid 27, the edge 8*a* of the front face 8 of the container 26, and two cuts 21 made along the top part of each corner edge 22 bordering the front face 8. The opening 20 serves to expose a given area of the breast piece 16 presented by the frame 15, which exhibits a plurality of windows 23 consisting in respective void portions of the frame 15 positioned to reveal corresponding portions 24 of the coupon 19 bearing written and pictorial matter addressed to the consumer, thereby obviating the need to print such matter directly on the carton 25.

In the example of FIG. 10, the opening 20 is positioned to coincide with the top edge 18 of "U" outline presented by the frame 15, which therefore is not pierced with windows 23 as in the example of FIG. 9; instead, the void portion of the frame 15 is compassed between the top edge 18 of the frame 15 and the free edge 11*a* presented by the front face 11 of the lid 27 when the lid occupies the position enclosing the top end of the container 26. Likewise in this instance the void portion of the frame 15 is positioned to expose corresponding portions 24 of the coupon 19 bearing written and pictorial matter addressed to the consumer, thereby obviating the need to print such matter directly on the carton 25.

Whilst in both of the examples illustrated in FIGS. 9 and 10 the opening 20 presents the appearance substantially of a rectangle referable to an axis extending parallel with the hinge line 6, it will be evident that all the embodiments of the opening 20 illustrated in FIGS. 3 to 8 are applicable to packet 2 and carton 25 alike.

Figure 11:
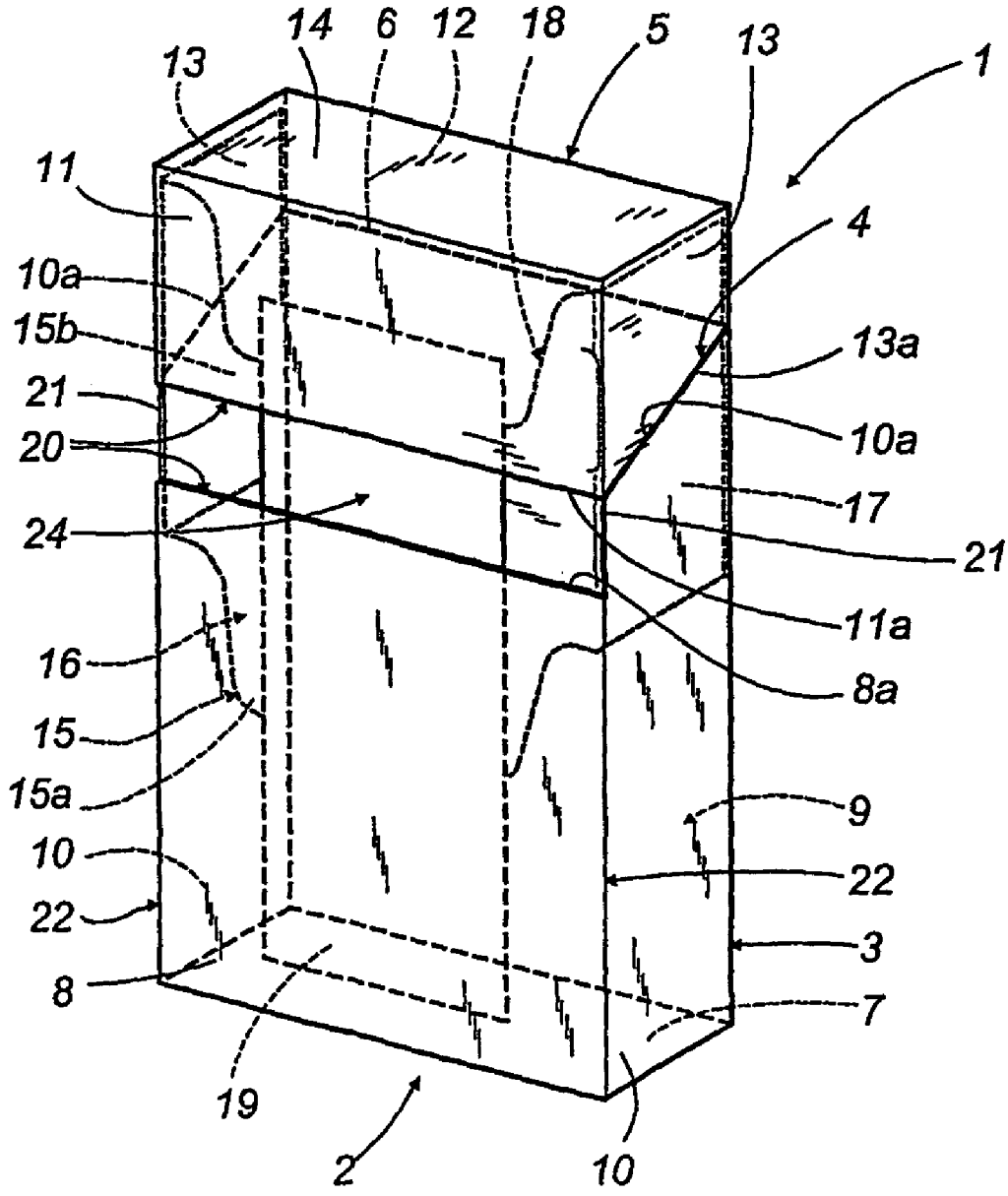
FIG. 11 illustrates a third embodiment of a packet of cigarettes according to the present invention, viewed schematically and in perspective.

The packet 2 shown in the example of FIG. 11 is similar to the packet 2 of FIG. 1 in terms of geometry, but with the difference that the coupon 19 is interposed between the breast piece 16 of the frame 15 and the insides of the front face 8 of the container 3 and the front face 11 of the lid 5. In this instance there is no need for the windows 23 in the frame 15 since the opening 20 compassed between the two free edges 8*a* and 11*a* of the front faces will reveal at least the portion 24 of the coupon 19 of interest to the consumer.

The invention claimed is:

1. A pack of rigid type with a hinged lid for tobacco products, comprising:

a container of cupped embodiment having a bottom end face and a rear face, also a front face and two flank faces of which free edges thereof define an open end of the container;

a reinforcing frame having a breast piece and two side pieces associated respectively with the front face and flank faces of the container, projecting partly from the open end of the container and having an upper of U profile directed toward the lid;

the lid likewise of cupped embodiment and having a top end face, a front face and two flank faces with respective free edges, and a rear face connected by way of a hinge line to the rear face of the container, rotatable thus between an open position and a position of interaction with the frame in which the open end of the container is closed; and a coupon located between the frame and the tobacco products, wherein, with the lid occupying the closed position, at least one part of the free edge of the open end of the container and a part of the free edge of the lid are separated one from the other by a predetermined distance so as to create an opening that serves to expose at least one void portion of the frame serving in turn to reveal at least one corresponding portion of the coupon.

2. A pack as in claim 1, wherein the void portion is a portion of the U profile above the breast piece of the frame.

3. A pack as in claim 1, wherein the void portion includes at least one window pierced in the breast piece of the frame.

4. A pack as in claim 1, wherein the opening appears as a substantially rectangular band aligned on an axis extending parallel with the hinge.

5. A pack as in claim 1, wherein the opening appears as a curved band aligned on an arc to a circle and with parallel edges.

6. A pack as in claim 1, wherein the opening appears as a Vee-shaped band with parallel edges.

7. A pack as in claim 1, wherein the opening appears as a substantially rectangular band aligned on an axis extending skewed relative to the hinge line.

8. A pack as in claim 1, wherein the opening appears as a substantially undulating band with parallel edges.

9. A pack as in claim 1, wherein the opening appears as a substantially multiangular band with parallel edges.

10. A pack as in claim 1, wherein the opening appears as a substantially multiangular band with non-parallel edges.

11. A pack as in claim 1, wherein the tobacco products are a plurality of packets of cigarettes and the pack is a carton.

12. A pack as in claim 1, wherein the tobacco products are a group of cigarettes, and the pack is a packet of cigarettes.

13. A pack of rigid type with a hinged lid for tobacco products, comprising;

a container of cupped embodiment having a bottom end face and a rear face, also a front face and two flank faces of which free edges thereof define an open end of the container;

a reinforcing frame having a breast piece and two side pieces associated respectively with the front face and flank faces of the container, projecting partly from the open end of the container and having an upper of U profile directed toward the lid;

the lid likewise of cupped embodiment and having a top end face, a front face and two flank faces with respective free edges, and a rear face connected by a hinge line to the rear face of the container, rotatable thus between an open position and a position of interaction with the frame in which the open end of the container is closed, and a coupon interposed between the breast piece of the frame and inside of the front face of the container, and in that with the lid occupying the closed position, at least one part of the free edge afforded by the open end of the container and a part of the free edge of the lid are separated one from the other by a predetermined distance so as to create an opening that serves to reveal at least one corresponding portion of the coupon.

14. A pack as in claim 13, wherein the opening appears as a substantially rectangular band aligned on an axis extending parallel with the hinge line.

15. A pack as in claim 13, wherein the opening appears as a curved band aligned on an arc to a circle and with parallel edges.

16. A pack as in claim 13, wherein the opening (20) appears as a Vee-shaped band with parallel edges.

17. A pack as in claim 13, wherein the opening appears as a substantially rectangular band aligned on an axis extending skewed relative to the hinge line.

18. A pack as in claim 13, wherein the opening appears as a substantially undulating band with parallel edges.

19. A pack as in claim 13, wherein the opening appears as a substantially multiangular band with parallel edges.

20. A pack as in claim 13, wherein the opening appears as a substantially multiangular band with non-parallel edges.

* * * * *